US008974237B2

(12) United States Patent
Wehrle et al.

(10) Patent No.: US 8,974,237 B2
(45) Date of Patent: Mar. 10, 2015

(54) ELECTRICAL PLUG CONNECTOR HAVING A METALLIC PLUG PART WITH A DEFORMABLE TOLERANCE COMPENSATION PART

(71) Applicant: Coninvers GmbH, Herrenberg (DE)

(72) Inventors: Gerhard Wehrle, Donaueschingen (DE); Holger Ritter, Wurmberg (DE)

(73) Assignee: Coninvers GmbH, Herrenberg (DE)

( * ) Notice: Subject to any disclaimer, the term of this patent is extended or adjusted under 35 U.S.C. 154(b) by 18 days.

(21) Appl. No.: 13/792,579

(22) Filed: Mar. 11, 2013

(65) Prior Publication Data

US 2013/0237070 A1 Sep. 12, 2013

(30) Foreign Application Priority Data

Mar. 12, 2012 (EP) ..... 12401041

(51) Int. Cl.

| | |
|---|---|
| ***H01R 12/00*** | (2006.01) |
| ***H01R 13/64*** | (2006.01) |
| ***H01R 12/57*** | (2011.01) |
| ***H01R 13/631*** | (2006.01) |
| *H01R 13/11* | (2006.01) |
| *H01R 43/16* | (2006.01) |

(52) U.S. Cl.

CPC ..... *H01R 13/64* (2013.01); *H01R 12/57* (2013.01); *H01R 13/111* (2013.01); *H01R 13/6315* (2013.01); *H01R 43/16* (2013.01)

USPC ..... 439/83

(58) Field of Classification Search

USPC ..... 439/83, 342, 246

See application file for complete search history.

(56) References Cited

U.S. PATENT DOCUMENTS

| | | | | |
|---|---|---|---|---|
| 6,142,811 | A * | 11/2000 | Lin | 439/342 |
| 6,506,069 | B2 * | 1/2003 | Babala et al. | 439/248 |
| 6,558,177 | B2 * | 5/2003 | Havener et al. | 439/246 |
| 7,044,751 | B2 * | 5/2006 | Takanashi et al. | 439/76.2 |
| 7,143,651 | B2 * | 12/2006 | Sasaki et al. | 73/721 |
| 7,479,034 | B2 * | 1/2009 | Blakborn et al. | 439/578 |

(Continued)

FOREIGN PATENT DOCUMENTS

| | | |
|---|---|---|
| EP | 0 806 814 A1 | 11/1997 |
| EP | 1 209 771 A1 | 5/2002 |

(Continued)

OTHER PUBLICATIONS

European Search Report for corresponding European Application No. EP 12 40 1041 dated Aug. 6, 2012.

*Primary Examiner* — Chandrika Prasad

(74) *Attorney, Agent, or Firm* — Renner, Otto, Boisselle & Sklar, LLP

(57) ABSTRACT

An electrical plug connector with an insulating body that holds at least one metallic plug part that comprises at least one solder connection element that can be soldered to a circuit board, and at least one plug connection element for a matching plug part, both of which are connected with each other via a central piece of the plug connection element. The solder connection element may be connected via a tolerance compensation part with the central piece of the plug part, or directly with the plug connection element, in such a way that, relative to the position of the solder connection element—with the solder connection element soldered to the circuit board—the position of the plug connection element can be changed in any direction, parallel to the plane of the circuit board. In addition, the invention relates to a plug connector assembly.

7 Claims, 4 Drawing Sheets

(56) References Cited

U.S. PATENT DOCUMENTS

| | | | | |
|---|---|---|---|---|
| 8,183,527 | B2 * | 5/2012 | Taguchi et al. | 250/339.13 |
| 8,574,009 | B2 * | 11/2013 | Ho | 439/629 |
| 8,708,716 | B1 * | 4/2014 | Ho | 439/83 |
| 2002/0098730 | A1 | 7/2002 | Babala | |
| 2005/0032402 | A1 | 2/2005 | Takanashi | |
| 2010/0255685 | A1 | 10/2010 | Urano | |

FOREIGN PATENT DOCUMENTS

| | | | |
|---|---|---|---|
| EP | 1 505 380 | A2 | 2/2005 |
| EP | 1 861 898 | A | 12/2007 |
| WO | 2006/100035 | A1 | 9/2006 |

* cited by examiner

ELECTRICAL PLUG CONNECTOR HAVING A METALLIC PLUG PART WITH A DEFORMABLE TOLERANCE COMPENSATION PART

CROSS-REFERENCE TO RELATED APPLICATION

The present application claims priority under 35 USC §119 to European Patent Application No. 12 401 041.4 filed Mar. 12, 2012, the entire disclosure of which is incorporated herein by reference.

TECHNICAL FIELD OF THE INVENTION

The invention relates to an electrical plug connector with an insulating body that holds at least one metallic plug part that comprises at least one solder connection element that can be soldered to a circuit board, and at least one plug connection element for a matching plug part, with at least the solder connection element projecting at least partially beyond the insulating body, as well as a plug connector assembly.

DESCRIPTION OF THE RELATED ART

A problem with electrical plug connectors consists of producing socket and pin plug connectors—that can be plugged into each other and of which at least one plug connector is intended for soldering to a circuit board—which, despite a certain misalignment of some or all socket or pin-type plug parts, can be arranged without problems in a tolerance-afflicted receptacle after soldering to the circuit board. This problem will occur especially when the plug connector to be soldered comprises a large number of plug parts, or when several socket and/or pin-type plug connectors are arranged side-by-side on a circuit board and the electrical connection is to be established via a common group plug in a tolerance-afflicted receptacle. The displacement of the individual plug parts that will occur in this case, and therefore also that of the insulating bodies holding the plug parts, is caused by the manufacturing tolerances of the circuit board, of the electrical plug connectors, and the tolerances involved in the soldering of the socket or pin plug connectors to the circuit board. This problem is especially great with electrical plug connectors that are configured as a surface-mountable component. If the insulating body of such plug connectors is not positioned exactly as specified in the design, difficulties may also arise when a housing part with the chambers or passages that accept the soldered plug connectors, embracing and/or overlapping the associated insulating body, is to be installed.

To solve this problem, prior art proposes to hold the plug parts in floating condition in the associated insulating body. The publications EP 1 861 898 A1 and EP 0 806 814 A1 are cited as examples. However, that does not correct the misalignment of the plug parts so that the matching plug parts of the matching plug connector are difficult to join with the plug parts of the soldered plug connector, subjecting the soldered connection of the plug parts to mechanical stress. Over the long term, this may damage the soldered connections. In addition, the plug parts of the at least one soldered plug connector and/or the matching plug parts of the matching plug connector may be damaged or possibly even become unusable.

Regarding prior art, the publications EP 1 209 771 A2, US 2005/0032402 A1, US 2002/0098730 A1, EP 1 505 380 A2 and US 2010/0255685 A1 are also cited.

The publication EP 1 209 771 A2 discloses a coaxial connector with an insulating body (housing) that comprises two cylindrical cavities that are arranged one above the other in the plugging connection, are bounded by a circumferential wall, and are connected with each other. A metallic plug connector consisting of two pieces extends through the insulating body. In the cavity that comes first in the plugging direction, an elongated plug connection element is arranged, and in the following second cavity, a solder connection element is arranged, wherein the solder connection element is C-shaped and made of a spring material (bronze) while the plug connection element is pressed against the solder connection element by means of a spiral compression spring. The diameter of the cavity on the plugging side permits the lateral movement of the spiral compression spring and of the plug connection element so that the plug connection element and the solder connection element are able to move relative to each other, thus maintaining a direct electrical contact in between. The plug connection element and the solder connection element comprise essential, flat associated contact surfaces that are parallel-shiftable relative to each other.

For the installation of a second electronic control unit on a first electronic control unit, the publication US 2005/0032402 A1 proposes an electrical plug connection for connecting the two control units, with the first control unit comprising an integrated circuit board and the second control unit comprising a pressure sensor on the inside. The plug connection provided for this purpose comprises two plug parts that can be plugged together, of which one plug part is configured to be flexible in the plugging direction.

US 2002/0 98730 A1 discloses an electrical coaxial plug connector that is arranged in the face side of a cylindrical housing of a pressure sensor. The plug connector comprises a one-piece plug part with a plug connection element and a solder connection element that are both rigid and therefore inflexible. As connection with a circuit board, a foil connector with a circuit, i.e. a flexible circuit board, is provided to which the solder connection element of the plug part is soldered. The plug part is supported laterally shiftable in the housing and can be shifted transversely relative to the circuit board due to the foil connector that leads to the center contact.

The patent disclosure EP 1 505 380 A2 discloses a plug connector that comprises at least one metallic plug part consisting of two pieces that is composed of one inflexible plug connection element and one spring contact for a substrate, e.g. a circuit board, that is fixed on the plug connection element and is flexible in the plugging direction. The connection element provided for the connection with the circuit board is not configured as a solder connection element but rather as a spring contact for a frictional connection with a circuit board. As a consequence of the frictional connection, the plug part is able to move in any direction relative to the substrate.

US 2010/0255685 A1 proposes an electrical connector with a two-piece plug part that can be soldered to a circuit board and comprises a plug connection element and a solder connection element. These can be shifted relative to each other in one direction parallel to the circuit board, and are connected with each other frictionally in this direction, with the plug connection element also comprising a partial piece that extends in meandering fashion and supports a shift of the plug connection element relative to the solder connection element.

With reference to the prior art cited above, the invention addresses the problem of proposing a possibility of tolerance compensation between the plug parts, soldered to a circuit board, of at least one plug connector and one receptacle for the insulating body, or bodies, in which the metallic plug parts are held.

SUMMARY OF THE INVENTION

According to the invention, this problem is solved by an electrical plug connector as described herein. In the electrical plug connector according to the invention, the plug connection element is connected, directly or indirectly, with the solder connection element via a tolerance compensation part in such a way that, relative to the position of the solder connection element—with the solder connection element being soldered to the circuit board—the position of the plug connection element can be changed in any direction, parallel to the plane of the circuit board. The plug part may be composed of one or several pieces. If composed of several pieces, the individual parts may be joined with each other mechanically and electrically by means of suitable joining methods known to a person skilled in the art. If the plug part consists of a single piece, the tolerance compensation part is incorporated in a suitable place in the area of a central piece that connects the plug connection element and the solder connection element. If the plug part is composed of several pieces, it is formed as an integral part of the plug connection element or of the solder connection element of the at least one plug part. Ideally, in relation to the central piece, the plug connection element, and/or the solder connection element, the tolerance compensation part is designed geometrically in such a way that it can be deformed relative to said elements with less force.

Preferably, the tolerance compensation part has an S-shaped, U-shaped, circular, spiral-shaped, or wavelike contour. However, the invention is not limited to the contours referred to above. It is essential that the preferred contours make it possible to effect, with low force, a displacement of the plug connection element relative to the solder connection element in any spatial direction parallel to the circuit board to which the at least one plug connector is soldered.

In preferred embodiments of the invention, the plug part consists of two pieces, with the plug connection element and the tolerance compensation part being frictionally or positively connected with each other. The tolerance compensation part extends, with or without pre-tension, in a straight line perpendicular to the plane of the circuit board, and curved in the extension direction of the circuit board. It is flexible, i.e. deformable, and can be bent reversibly or irreversibly by a small force acting parallel to the plane of the circuit board. For this purpose, the solder connection element is cut from or punched out of a strip-like material. It is connected to the plug connection element in such a way that the flat sides of the tolerance compensation part are arranged perpendicular to the plane of the circuit board when the plug connector is soldered to the circuit board. Soldering pins formed as parts of the solder connection element that are provided for push-through installation may also extend in that plane. As an alternative, soldering tabs formed at an angle as parts of the solder connection element may extend perpendicularly to this plane.

In the electrical plug connector according to the invention, all plug parts comprise such a tolerance compensation part on their solder connection elements. The tolerance compensation parts are arranged relative to each other in such a way that they are not in each other's way and also do not contact each other when the plug connection elements are being aligned. The alignment of the plug connection elements relative to each other is accomplished indirectly by means of the alignment of the insulating body of the electrical plug connector. In the area of the tolerance compensation parts, the insulating body may comprise dividing walls that keep the tolerance compensation parts securely separated from each other electrically. In order to prevent an undesirable deformation of the at least one plug connection element during the alignment of the proposed plug connector, and in order to prevent unnecessary force from being exerted on the associated soldering pin or tab, the tolerance compensation part preferably has a distinctly lower flexural stiffness than the plug connection element and the soldering pins or tabs of the solder connection element.

The proposed electrical plug connector may comprise either only pin-shaped, only socket-shaped, or pin and socket-shaped plug parts arranged side-by-side. The plug connection elements and/or the solder connection elements of the socket-shaped or pin-shaped plug parts may be identical in terms of size and shape, or may have different shapes. The same is true for the tolerance compensation parts of the solder connection elements.

The solder connection element and the plug connection element of the plug connector according to the invention may be connected with each other mechanically and electrically conductively either only by means of the tolerance compensation part or, for example, by means of an additional central piece and the tolerance compensation part. This can be accomplished by means of several measures known from prior art. Preference is given to an embodiment of the invention wherein the tolerance compensation part is welded directly to the plug connection element or to the central piece, preferably by means of spotwelding. This produces a durable and secure connection that is also distinguished by extremely low electrical impedance.

The deformability of the tolerance compensation part depends not only on the chosen geometry of the tolerance compensation part but also on the material thickness of the material of which the tolerance compensation part and the solder connection element formed as a part thereof are made, and also on the specific material characteristics of this material. In a favored variant of the plug connector according to the invention, the tolerance compensation part or the solder connection element consist of a material whose characteristics and/or thickness differ from the material of the central piece and the plug connection element formed as a part thereof, or from the material of the plug connection element. Thus, a special material suitable for the specific functions of these parts can be selected without any need for compromises.

Expediently, an elastically deformable material is used for the plug connection element and preferably a plastically deformable material for the solder connection element. As a consequence, the tolerance compensation part, in conjunction with a suitable geometry, can easily be deformed plastically so that the alignment of the insulating body with the plug parts contained therein relative to the circuit board is permanent. In addition, the plastic deformation of the tolerance compensation part in question prevents a permanent force from being exerted on the soldered joint of the electrical plug connector according to the invention and on the plastic material of the insulating body.

Preferably, at least the tolerance compensation part with the solder connection element formed thereon is a stamped bent part that can be produced cost-efficiently in a conventional way. The solder connection element may comprise soldering pins or soldering tabs that are formed as integral parts of the tolerance compensation part.

In a plug connector assembly with at least two plug connectors soldered to the circuit board as referred to above, the tolerance compensation offered by the special design is especially effective.

Below, the invention is explained in detail with reference to an embodiment shown in the drawing. Additional characteristics of the invention are given in the following description of the embodiment of the invention in conjunction with the claims and the attached drawing. The individual characteristics of the invention may be realized either individually by themselves or in combinations of several in different embodiments of the invention.

DETAILED DESCRIPTION OF THE INVENTION

Figure 1:
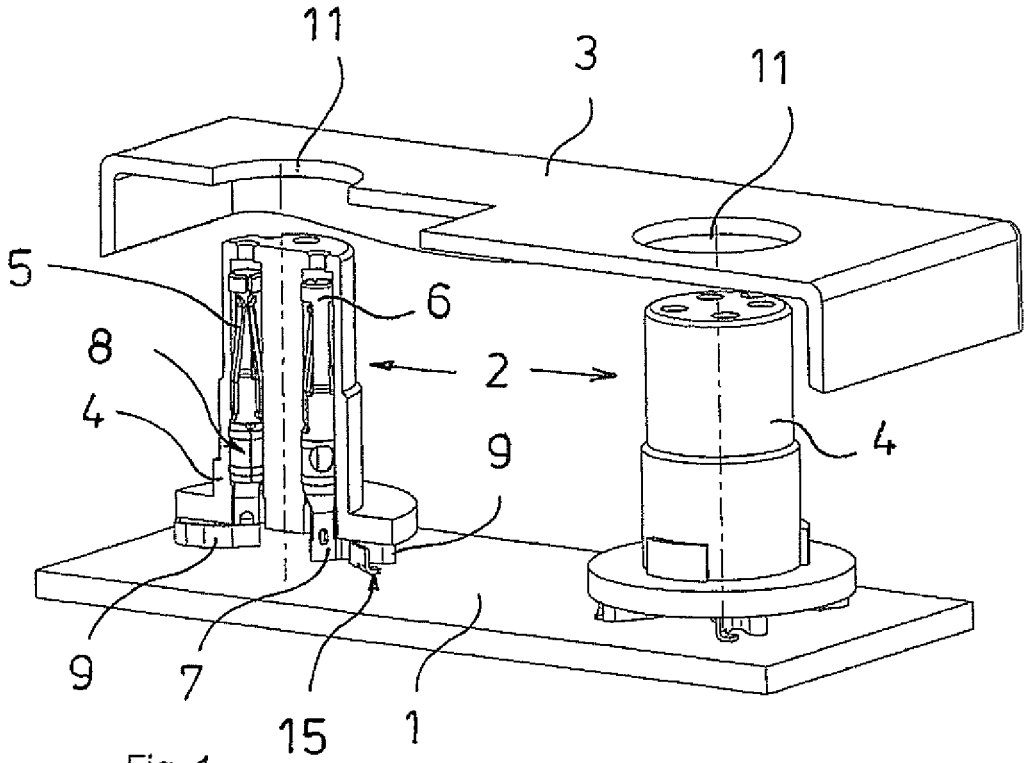
FIG. 1 shows two electrical plug connectors according to the invention with a cylindrical insulating body, arranged side-by-side at a distance from each other on a circuit board.

By way of example, FIG. 1 shows a plug connector assembly with only two electrical plug connectors 2 that are arranged side-by-side at a distance from each other on a circuit board 1 (not shown) to which they are soldered. The plug connectors 2 are provided as surface-mountable components. Above the circuit board 1 with the plug connectors 2, the Figure shows a receptacle 3 through which the plug connectors 2 are intended to pass. The receptacle may consist of a flange, for example, with which the plug connectors 2 with the circuit board 1 are attached to a housing, or may consist directly of a housing wall of a housing holding the plug connectors 2, the circuit board 1, and possibly additional elements. The plug connectors 2 comprise a cylindrical insulating body 4 with four plug parts 5 held therein. The plug parts 5 are visible in the left plug connector 2 that is shown in a longitudinal section view.

The plug parts 5 comprise plug connection elements 6 and solder connection elements 15 (soldering pin or soldering tab; in this instance: soldering tab). In the embodiment shown here, the plug connection elements 6 consist of sockets and extend in the longitudinal direction of the insulating body 4 and perpendicularly to the circuit board 1. Tolerance compensation parts 7 with a curved section 9 are located between the plug connection elements 6 and the solder connection element 15. The tolerance compensation parts 7 are arranged transversely in relation to the plug connection elements 6 and extend, in upright condition, radially to the plug connection elements 6 and parallel to the circuit board 1. In this embodiment, the plug connection elements 6 comprise central pieces 8 that are connected to the tolerance compensation part 7 by means of welding. The tolerance compensation part 7 of the plug parts 5 is deformable in any direction in section 9, parallel to the plane of the circuit board 1.

Figure 2A:
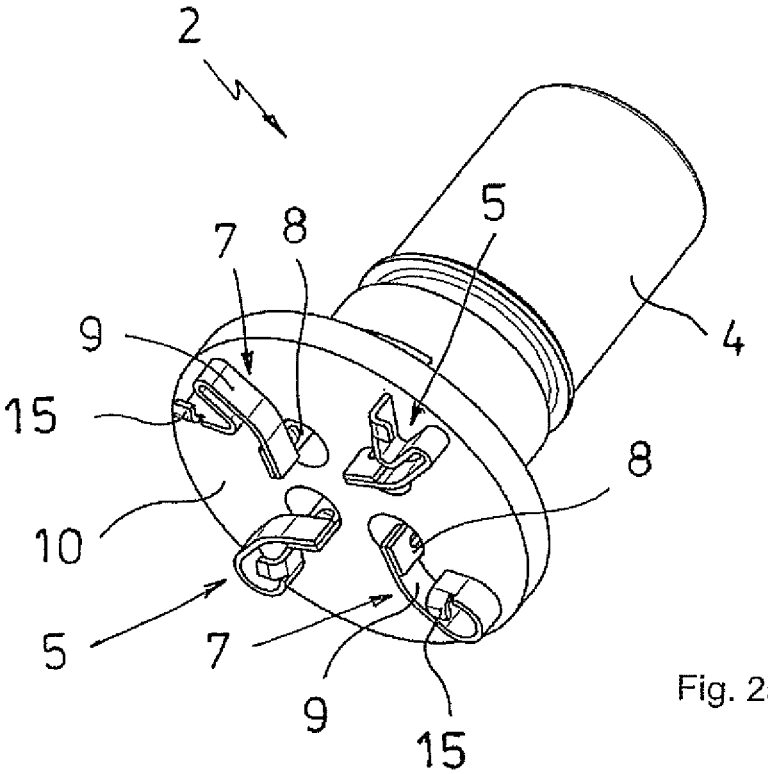
FIG. 2 shows the plug connector from FIG. 1, in a view at an angle from below of the soldering side of the plug connector, from two different viewing directions (FIG. 2*a*, 2*b*)
Figure 2B:
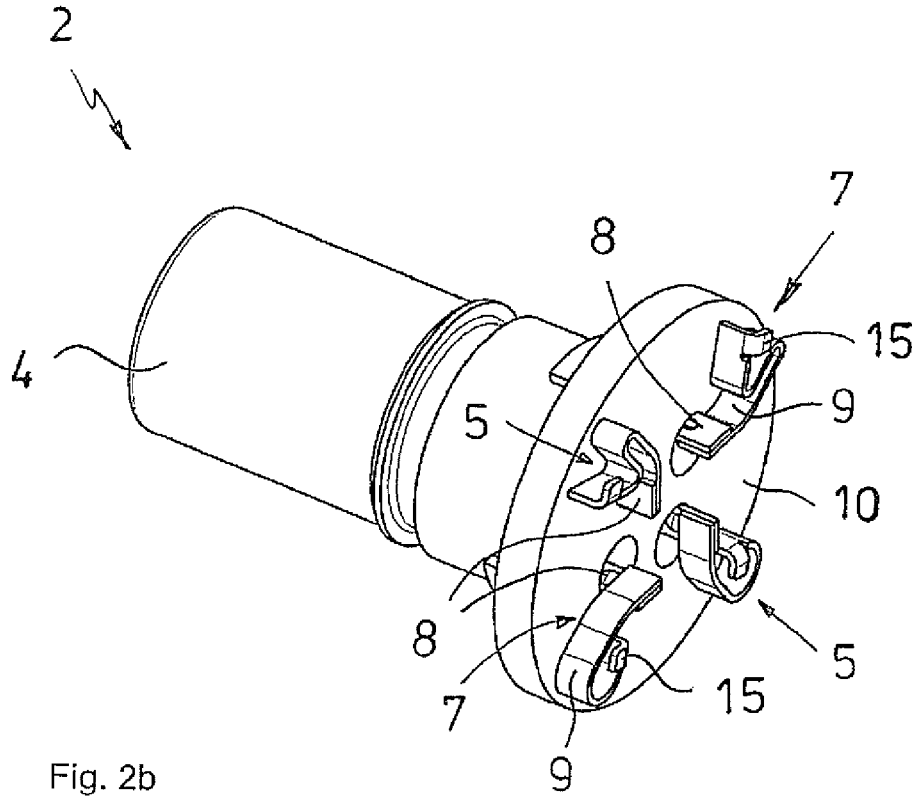

FIGS. 2*a*, 2*b* show one of the plug connectors 2 from FIG. 1, that are all of identical design, in a view, at an angle from below, of the bottom 10 of the insulating body 4 of the plug connection element 2. The FIGS. 2*a*, 2*b* show the plug connector 2 from different viewing directions. It can clearly be seen that the four central pieces 8 project from the bottom 10, and that the tolerance compensation parts 7 welded to these extend transversely to this bottom. The plug connection elements 6, the solder connection elements 15, the central pieces 8, and the tolerance compensation parts 7 are each made as stamped bending parts from a narrow strip of material and are suitably shaped by bending. In this embodiment, the tolerance compensation parts have different shapes, but this is not essential. The material height of such a tolerance compensation part 7 with solder connection element 15 formed as part thereof is approximately 1 to 2 mm, the material thickness is approximately 0.2 to 0.3 mm. These are typical values, but other values may be chosen.

As FIGS. 2*a*, 2*b* show, the tolerance compensation parts 7 have a different and complex shape transversely to the plane of the circuit board 1 and to the center axis of the insulating body 4. In the section 9, they are bent differently, in circular shape or spiral shape, or in a wavelike shape. As a consequence, the tolerance compensation parts 7 may be deformed by means of bending, to a structurally given extent, parallel to the plane of the circuit board 1 in order to align the electrical plug connector 2 relative to the circuit board 1. This is necessary in case the respective insulating bodies 4 with the plug parts 5 held therein are not precisely aligned with the passages 11 of the receptacle 3 when the receptacle 3, overlapping and embracing the plug connector 2, is to be lowered in the direction of the circuit board 1, as shown in FIG. 1.

Figure 3:
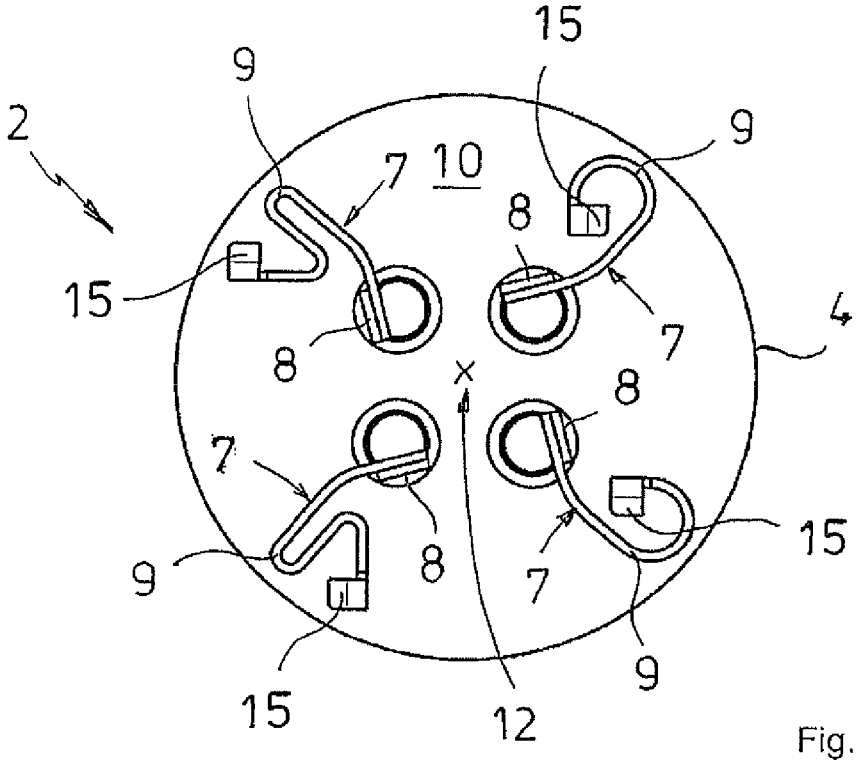
FIG. 3 shows the plug connector from FIG. 1 in a plan view from below.
Figure 4A:
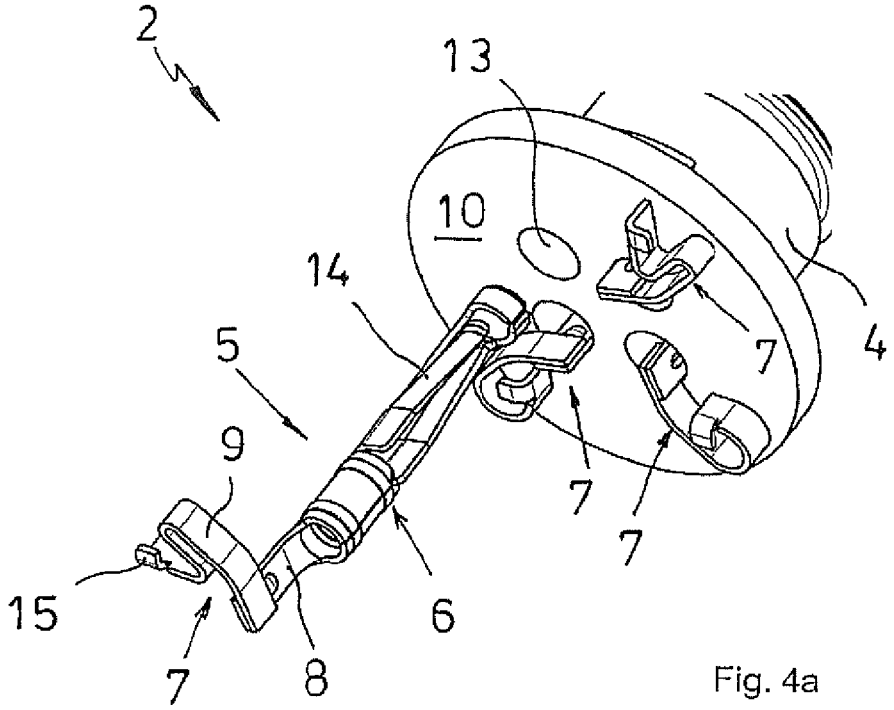
FIG. 4 shows the plug connector from FIG. 2*b* with one plug part in each case not yet inserted into the insulating body (FIG. 4*a*, 4*b*, 4*c*, 4*d*).
Figure 4B:
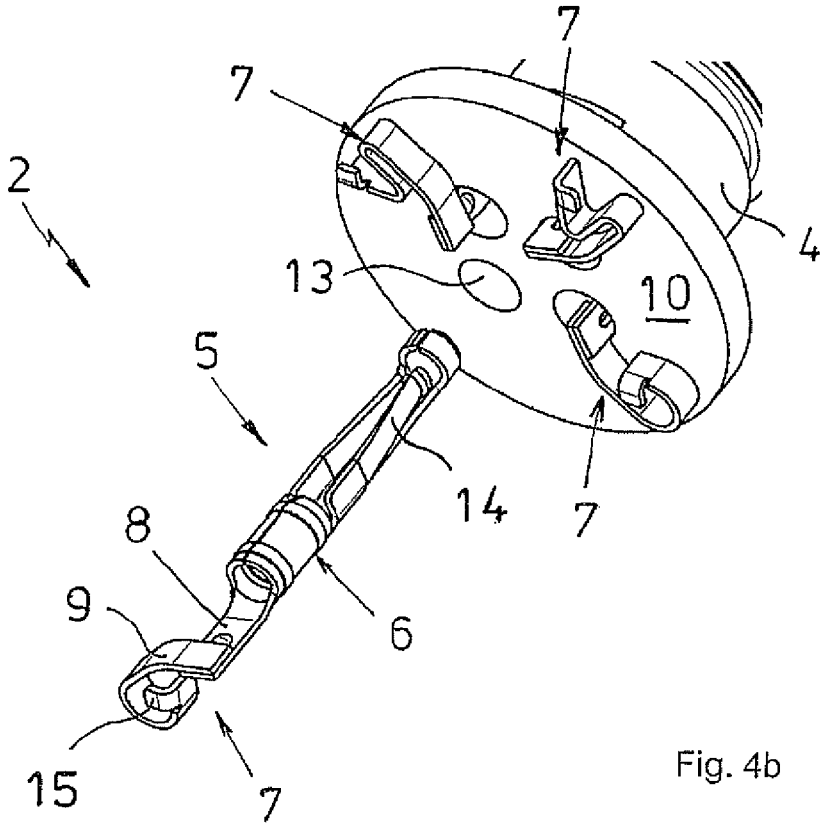
Figure 4C:
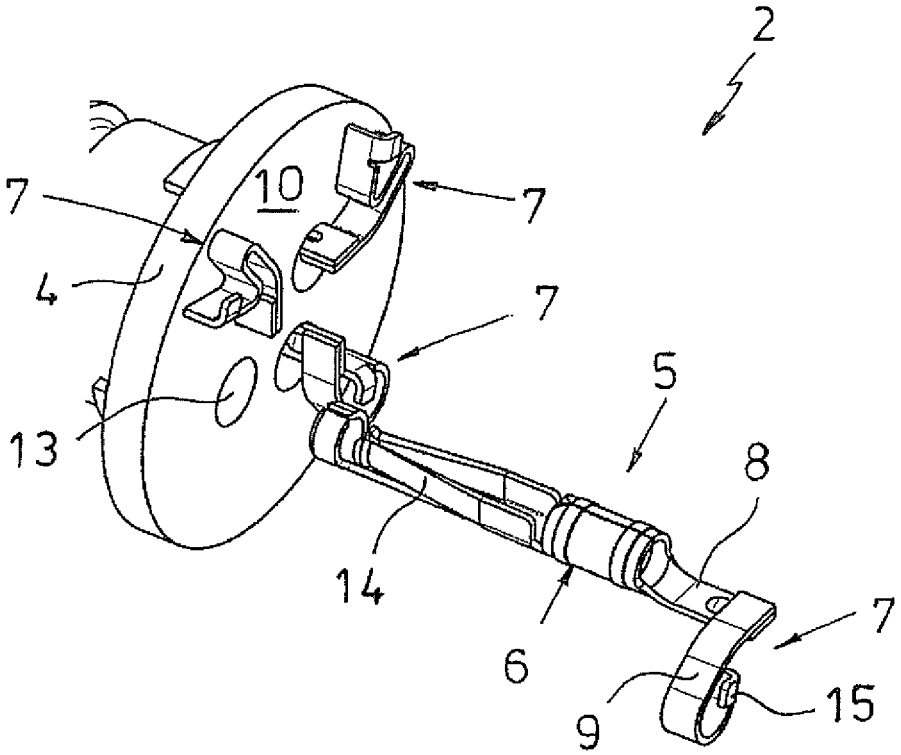
Figure 4D:
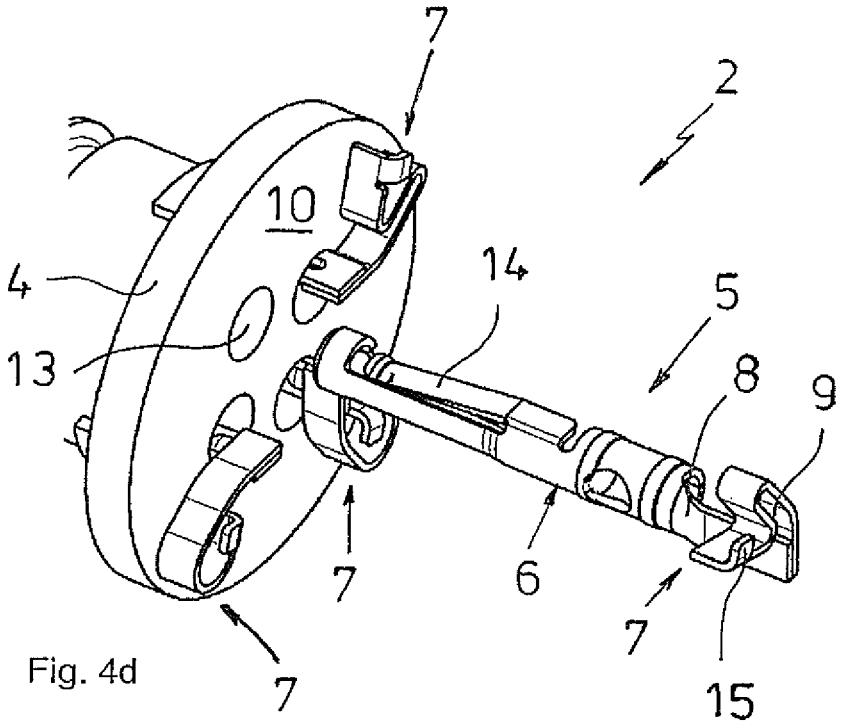

FIG. 3 shows the proposed plug connector 2 in a plan view of the bottom 10 of the insulating body 4. In this Figure, the different shape of the tolerance compensation parts 7 is shown clearly once again. Each of the tolerance compensation parts 7 extends radially to the insulating body 2. The tolerance compensation parts 7 are shaped in such a way that the insulating body 4 can be moved translationally in any direction parallel to its center axis 12 and to the plane of the circuit board 1 (not shown). Simultaneously, a rotational movement of the insulating body 4 around its center axis 12 is possible. As a consequence, with different deformations of the tolerance compensation parts 7 of the plug parts 5 taking place, the electrical plug connector 2 according to the invention can be aligned precisely, reversibly or irreversibly, in relation to the circuit board 1 and the circuit board cover 3.

FIGS. 4*a* to 4*d* show the plug connector 2 represented in this embodiment of the invention, each Figure with one plug part 5 not yet axially inserted into the insulating body 4. Here, the receptacle chamber 13 is clearly visible into which the plug connection element 6 locks automatically as soon as it has been fully inserted. According to the FIGS. 4*a* to 4*d*, the plug connection elements 6 are all identical and have the shape of hollow cylinders with spring contact tabs 14. It can also be seen clearly that the plug connection elements 6 each consist of two parts, and that the central pieces 8 are connected, transversely in relation to each other, with the plug connection elements 6 and the tolerance compensation parts 7 with the solder connection elements 15. Once again, the comparison clearly shows the different shapes of the tolerance compensation parts 7 with the soldering tabs 15 and the differently sized and shaped sections 9.

Usually, plug parts of an electrical plug connector each comprise only one plug connection element with a pin or a socket and one solder connection element with a soldering pin or a soldering tab. However, for special applications, a plug part may also be designed with two suitable plug connection elements and/or solder connection elements with tolerance compensation parts.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. An electrical plug connector with an insulating body that holds at least one metallic plug part that comprises at least one solder connection element that can be soldered to a circuit board, and at least one plug connection element for a matching plug part, with the plug connection element extending in a longitudinal direction of the insulating body and perpendicular to the circuit board with at least the solder connection element projecting at least partially beyond the insulating body, wherein the plug connection element has the shape of a hollow cylinder with spring contact tabs and is connected with the solder connection element of the at least one plug part by means of a tolerance compensation part, arranged between the plug connection element and the solder connection element, in such a way that, relative to the position of the solder connection element—with the solder connection element soldered to the circuit board—the position of the plug connection element and/or the insulating body can be changed in any direction, parallel to the plane of the circuit board, with the tolerance compensation part deforming, and that the plug part may be composed of one or several pieces, wherein, if the plug part consists of a single piece, the tolerance compensation part is formed in a suitable place in the area of a central piece that connects the plug connection element and the solder connection element, and wherein, if the plug part is composed of two pieces, the tolerance compensation part is formed as an integral part of the solder connection element and is connected positively with the plug connection element, wherein the tolerance compensation part is arranged transversely in relation to the plug connection element and extends, in upright condition, radially to the plug connection element and parallel to the circuit board and in a straight line perpendicular to the plane of the circuit board and curved in the extension direction of the circuit board and having a S-shaped, U-shaped, circular, spiral-shaped or wave-like contour.

2. The plug connector according to claim 1, wherein the tolerance compensation part comprises an area with an S-shaped, U-shaped, circular, spiral-shaped, or wavelike contour.

3. The plug connector according to claim 1, wherein in case of a two-piece configuration of the plug part, the tolerance compensation part is welded to the plug connection element.

4. The plug connector according to claim 1, wherein that the tolerance compensation part with the solder connection element and the plug connection element consist of different materials.

5. The plug connector according to claim 4, wherein that the material of the tolerance compensation part is plastically deformable.

6. The plug connector according to claim 1, characterized in that at least the tolerance compensation part with the solder connection element formed thereon is a stamped bending part.

7. A plug connector assembly with at least two plug connectors according to claim 1 that are soldered to the circuit board.

* * * * *